United States Patent [19]

Fresard et al.

[11] 4,036,158

[45] July 19, 1977

[54] SEWING MACHINE

[75] Inventors: Marcel Fresard, Petit-Lancy, Geneva; Olindo Baruffa, Thonex, Geneva; Jean-Pierre Gabriel, Veyrier, Geneva, all of Switzerland

[73] Assignee: Mefina S.A., Fribourg, Switzerland

[21] Appl. No.: 684,938

[22] Filed: May 10, 1976

[30] Foreign Application Priority Data

May 16, 1975 Switzerland ..... 6367/75

[51] Int. Cl.[2] ..... D05B 75/00

[52] U.S. Cl. ..... 112/258

[58] Field of Search ..... 112/217.1, 260, 258; 248/19, 188.1

[56] References Cited

FOREIGN PATENT DOCUMENTS

| | | | |
|---|---|---|---|
| 657,270 | 2/1938 | Germany | 112/260 |
| 919,388 | 10/1954 | Germany | 112/258 |

*Primary Examiner*—George H. Krizmanich

*Attorney, Agent, or Firm*—Emory L. Groff, Jr.

[57] ABSTRACT

A sewing machine has an upper arm and a lower free arm carried by a column and two longitudinal supports disposed on either side of the free arm and connected to the base of the column. At least one of the supports is slidable laterally outwards from a position closing off the free arm to a position allowing access to the free arm under the action of a biasing spring, but is retained in the withdrawn position by a catch cooperating with an abutment on a transverse guide rod fixed on the support.

12 Claims, 8 Drawing Figures

FIG. 4
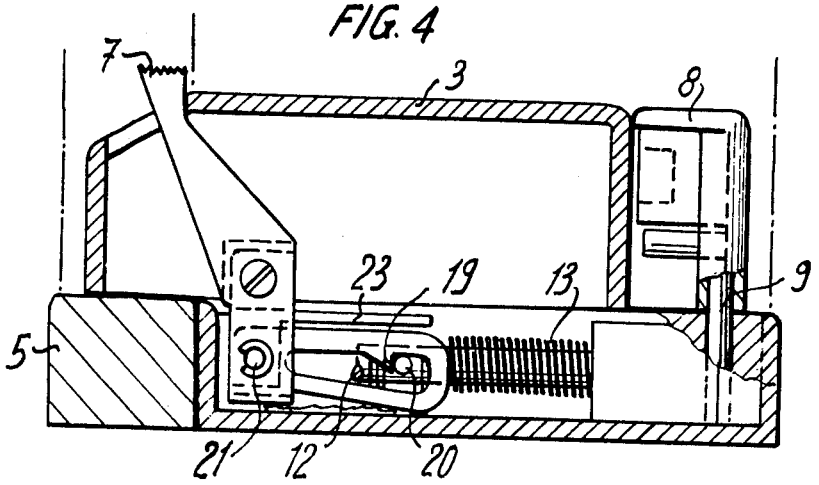
FIG. 5
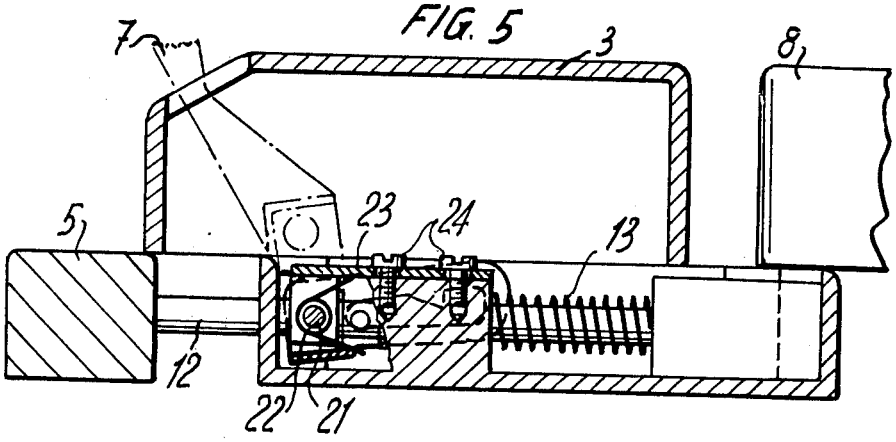
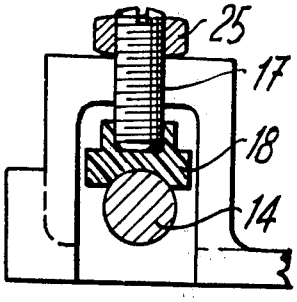
FIG. 6

SEWING MACHINE

There are already known sewing machines with a free arm comprising a removable table which, when it is disposed about the upper face of the free arm, enables an increase in the working surface. This table may either be independent, or articulated to the machine or its pedestal.

These machines have the disadvantage that when they are used for sewing that does not require use of the free arm, their working surface is situated at a level substantially higher than that of a table on which the machine is placed.

To obviate this disadvantage, one has sought to bring the free arm as close as possible to the base of the machine.

The sewing machine according to the invention, whose frame includes a column, an upper arm and a free arm carried by the column, and two longitudinal supports disposed on either side of the free arm and connected to a base of the column, is characterized in that at least one of the longitudinal supports is movable laterally between a position adjacent one of the lower longitudinal edges of the free arm and a position spaced apart from the free arm.

The accompanying drawings show, schematically and by way of example, an embodiment of the sewing machine according to the invention, and a variation of a detail. In the drawings:

FIG. 3 is a partly cut-away top plan view of the base of the machine before the column is fitted on;

FIG. 4 is a cross-section along line IV—IV of FIG. 3, with the free arm non-accessible;

FIG. 5 is a cross-section along line V—V of FIG. 3, with the free arm accessible;

FIG. 6 is a cross-section along line VI—VI of FIG. 3 showing a structure detail to an enlarged scale;

The sewing machine shown comprises a column 1, an upper arm 2 and a free arm 3 carried by the column 1. The column 1 is mounted on a base 4 to which are connected two supports extending longitudinally under the free arm 3.

Figure 3:
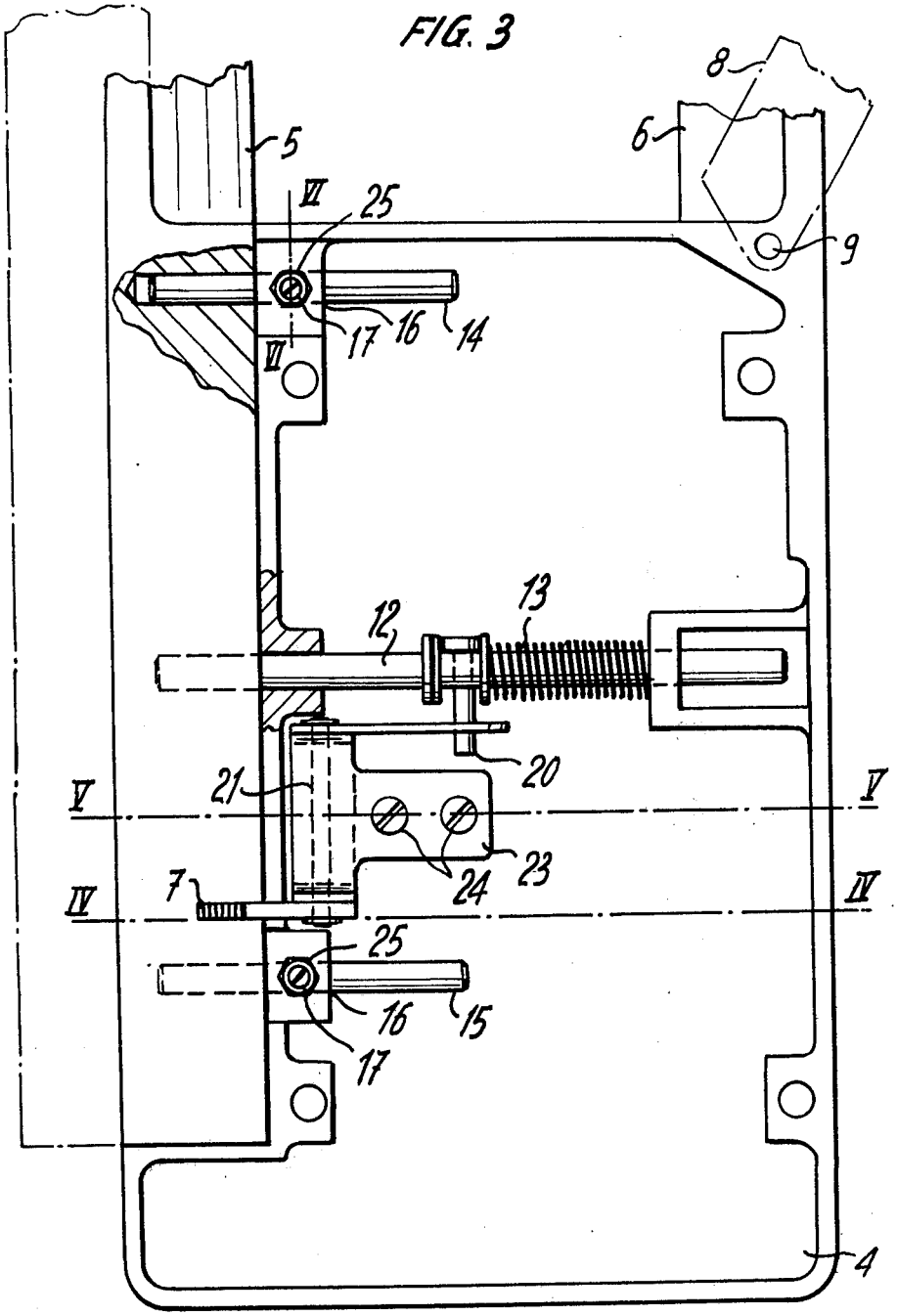

One of these longitudinal supports is formed by a bar 5 disposed in extension of a longitudinal edge of the base 4 and connected to the latter by a mechanism shown in FIG. 3. This mechanism, which will be described later on, enables the bar 5 to be moved laterally in relation to the base 4.

The other longitudinal support is formed by a fixed bar 6 integral with the base 4 and defining its other longitudinal edge.

Figure 1:
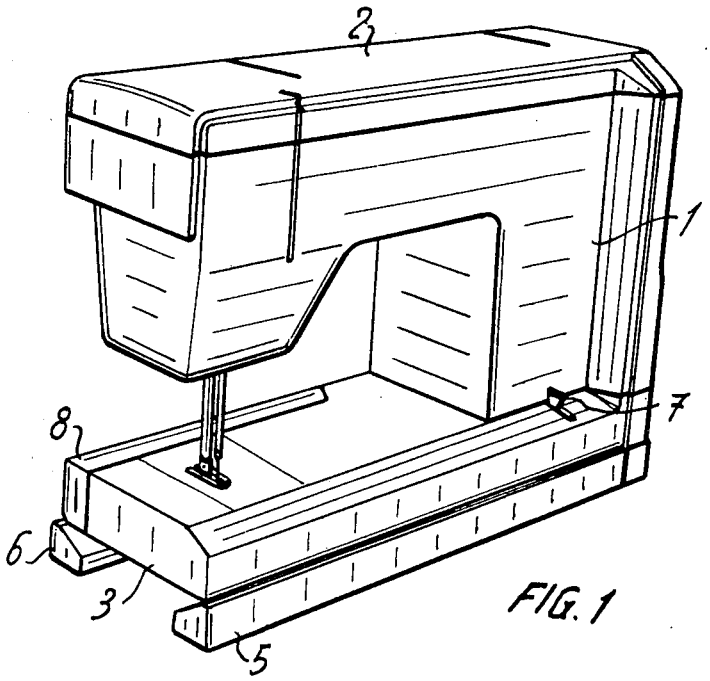
FIG. 1 is a perspective view of the sewing machine, with the free arm non-accessible.
Figure 2:
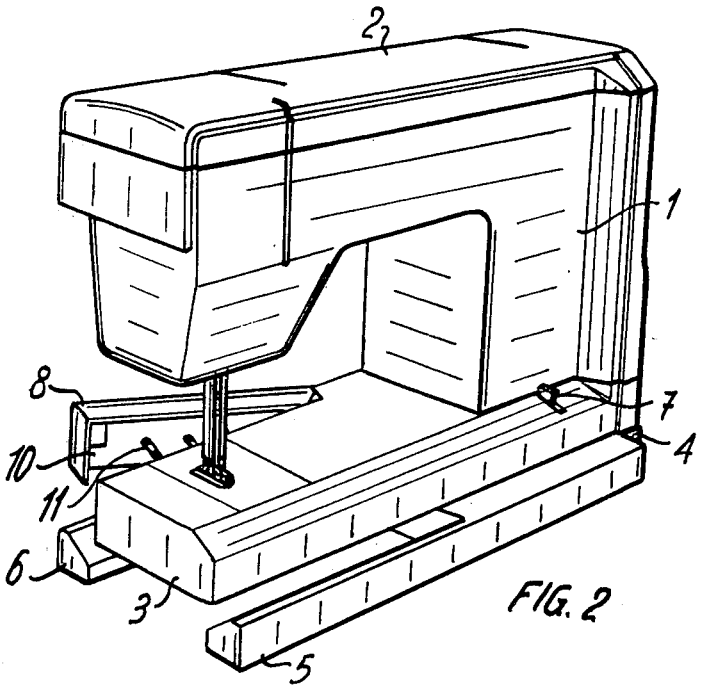
FIG. 2 is a perspective view thereof, with the free accessible.

When access to the free arm 3 is not required, the bar 5 is disposed adjacent to and under the lower longitudinal edge of the free arm 3, as shown in FIG. 1. When it is desired to sew tubular pieces requiring access to the free arm 3, a control lever 7 of the mentioned mechanism is actuated to move the bar 5 to a position allowing access to one of the longitudinal edges of the free arm 3, as shown in FIG. 2.

The other longitudinal edge of the free arm 3 comprises a piece 8 which can be separated from the free arm 3 by pivoting about a pin 9 (see FIGS. 3 to 5). This side of the free arm can thus be made accessible without lateral displacement of the bar 6 which is fixed to the base 4. It suffices to space the piece 8 apart from the remainder of the free arm 3 as shown in FIG. 2 to leave a sufficient space free between the remainder of the free arm 3 and the bar 6. As shown on FIG. 2, the piece 8 has a housing 10 in which bobbin supports 11 or other accessories are disposed.

The mechanism enabling the bar 5 to be spaced apart from the free arm 3 by actuation of the lever 7 comprises a rod 12 slidably mounted transversally in the base 4 of the column and a member for locking this rod 12 in a retracted position against the action of a biasing spring 13. One end of rod 12 is fixed to the bar 5 which is also provided, on either side of the rod 12, with two auxiliary transverse guide rods 14 and 15 also penetrating in the base 4 by passages 16 at a height which can be regulated by means of a screw 17 acting on a slide element 18 as best shown in FIG. 6.

Locking of the rod 12 in its retracted position shown in FIGS. 3 and 4 is achieved by means of a catch 19 which engages a pin 20 protruding at right angles from the road 12 (FIG. 4). This catch is mounted on the same pin 21 as the control lever 7 and is biased towards the locking position by a spring 22 (FIG. 5).

A support plate 23 for the bearing of pin 21 is mounted for movement parallel to the rod 12 to enable a precise regulation of the position of the catch 19. The plate 23 is fixed on the base 4, in the required position, by screws 24. Likewise, a precise alignment of the lower face of the bar 5 in the same plane as the lower face of the bar 6 is obtained by adjusting the position of the slide elements 18 by means of the screws 17 which are then locked by means of nuts 25.

Operation of the described mechanism is as follows:

To have access to the free arm 3 on the side of bar 5, the lever 7 is actuated to disengage the catch 19 from pin 20 whereupon the bar 5 is moved by the biasing spring 13 from its position shown in FIGS. 1 and 4 into that of FIGS. 2 and 5.

To have access to the other side of free arm 3, the piece 8 is pivoted about its pin 9 from the position shown in FIGS. 1 and 4 into that of FIGS. 2 and 5. The piece 8 could alternatively be detached from the free arm 3.

To return into the position of FIGS. 1 and 4, it suffices to manually push the bar 5 back against the action of spring 13 until the pin 20 is engaged by the catch 19, and to pivot the piece 8 about its pin 9 in the opposite direction to before. According to the variation shown in FIGS. 7 and 8, locking of the bar 5 in the retacted position is provided by means of a catch 29 which engages an abutment 33 on the auxiliary guide rod 15. The catch 29 is carried by a lever actuable by a button 27, and is biased into the locking position by a spring 32 (FIG. 8).

The abutment 33 is formed by the head of a screw 30 screwed in a tapped axial bore in the end of rod 15 which penetrates in the base 4. It is thus possible, by turning the screw 30 to adjust its penetration in the rod 15, to set the position of abutment 33.

Figure 8:
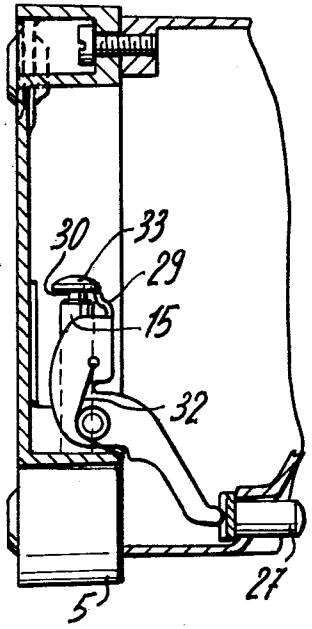
FIG. 8 is a cross-section along line VIII—VIII of FIG. 7.
Figure 7:
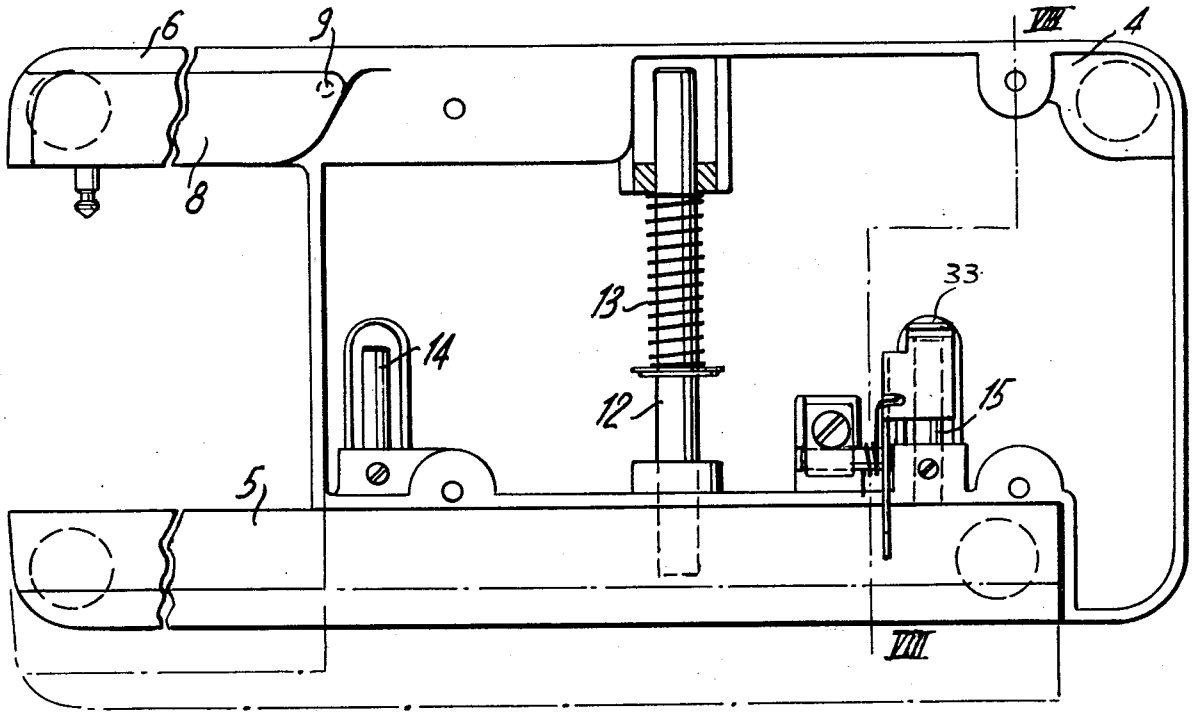
FIG. 7 is a view similar to FIG. 3 of the variation.

Operation of the mechanism is as follows:

To disengage the free arm at the side of bar 5, the button 27 is pressed to disengage catch 29 from the abutment 33, whereupon the bar 5 is moved by spring 13 from the position shown in FIGS. 7 and 8 to that shown in a chain line in FIG. 7.

Of course, instead of the device for locking the bar 5 in the retracted position being mounted on the auxiliary guide rod 15, it could for example be mounted on the auxiliary guide rod 14.

Numerous other variations of the described embodiment may be envisaged.

It is possible for example to mount the bar 6 for lateral movement in the same manner as the bar 5 to have access to the free arm 3; it would then no longer be necessary to provide the pivoting piece 8.

We claim:

1. In a sewing machine having a frame including a column, said column including a base, an upper arm and a free arm carried by said column, two longitudinal supports disposed on either side of said free arm, the improvement comprising guide means connecting said supports to said base means carried by said base and cooperating with said support connecting means for moving each of said supports laterally between a position adjacent a lower longitudinal edge of said free arm and a position spaced apart from said free arm.

2. A sewing machine according to claim 1, in which said guide means includes at least one piece fixed to said movable longitudinal supports and extending into the base of the column.

3. A sewing machine according to claim 2, including a biasing spring and a locking member cooperating with said piece extending into the base of the column.

4. A sewing machine according to claiim 1, including at least one regulating device enabling adjustment of the position of one of said longitudinal supports in relation to the other.

5. A sewing machine according to claim 1, in which said guide means includes at least two pieces fixed to said movable longitudinal support and penetrating in said base of the column, a biasing spring cooperating with a first of said pieces and a locking member cooperating with a second of said pieces.

6. A sewing machine according to claim 5, in which said locking member is a catch and said second piece includes an abutment engaged by said catch.

7. A sewing machine according to claim 6, in which said second piece is a rod extending from said movable longitudinal support to a free end, and including means defining a tapped axial bore in said free end of the rod, said bore receiving a screw having a head which forms said abutment.

8. A sewing machine according to claim 7, in which said screw forms a regulating device for setting said position adjacent a lower longitudinal edge of the free arm in which said movable longitudinal support is locked.

9. In a sewing machine having a frame including a column, said column including a base, an upper arm and a free arm carried by the column, two longitudinal supports disposed on either side of the free arm and connected to a base of the column, the improvement wherein one of said longitudinal supports is movable laterally between a position adjacent a lower longitudinal edge of the free arm and a position spaced apart from the free arm, while the other support is fixed adjacent another lower longitudinal edge of the free arm, said other longitudinal edge of the free arm including a part which is separable from the remainder of the free arm to leave a space between the remainder of the free arm and said fixed longitudinal support.

10. A sewing machine according to claim 9, in which said separable piece is articulated to the free arm at an end near the column.

11. A sewing machine according to claim 9, in which said piece which is separable from the remainder of the free arm has a housing providing an accessory box.

12. In a sewing machine having a frame including a column, said column including a base, an upper arm and a free arm carried by the column, two longitudinal supports disposed on either side of the free arm and connected to the base of the column, the improvement wherein one of said longitudinal supports is movable laterally between a position adjacent a lower longitudinal edge of the free arm and a position spaced apart from the free arm, while the other support is fixed close to another lower longitudinal edge of the free arm, a sufficiently wide space being provided between said other support and said other longitudinal edge of the free arm to permit access to the free arm for use in tubular sewing when said other support is moved laterally to its spaced position.

* * * * *